US007385575B2

(12) United States Patent
Seto

(10) Patent No.: US 7,385,575 B2
(45) Date of Patent: Jun. 10, 2008

(54) METHOD OF DRIVING LIGHT EMITTING ELEMENT ARRAY

(75) Inventor: Yasuhiro Seto, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 509 days.

(21) Appl. No.: 11/002,107

(22) Filed: Dec. 3, 2004

(65) Prior Publication Data

US 2005/0122054 A1 Jun. 9, 2005

(30) Foreign Application Priority Data

Dec. 3, 2003 (JP) ..... 2003-404549

(51) Int. Cl.
*G09G 3/32* (2006.01)

(52) U.S. Cl. ..... 345/82; 345/76; 250/205; 315/169.1

(58) Field of Classification Search ..... 345/76–83; 250/205; 315/169.1–169.4
See application file for complete search history.

(56) References Cited

U.S. PATENT DOCUMENTS 5,844,368 A 12/1998 Okuda et al.
6,201,520 B1 3/2001 Iketsu et al.
6,339,415 B2 * 1/2002 Ishizuka ..... 345/76
6,608,293 B2 * 8/2003 Kuderer ..... 250/200
6,839,245 B2 * 1/2005 Yasumura ..... 363/21.02
7,029,087 B2 * 4/2006 Tamura ..... 347/17
2001/0052926 A1 12/2001 Hori
2003/0030602 A1 * 2/2003 Kasai ..... 345/76
2004/0041756 A1 * 3/2004 Henmi et al. ..... 345/76
2004/0041758 A1 * 3/2004 Kurusu ..... 345/82
2004/0100428 A1 * 5/2004 Satoh ..... 345/76
2004/0217926 A1 * 11/2004 Kato ..... 345/76
2005/0111016 A1 * 5/2005 Yoneyama et al. ..... 358/1.9

* cited by examiner

*Primary Examiner*—Richard Hjerpe
*Assistant Examiner*—Kimnhung Nguyen
(74) *Attorney, Agent, or Firm*—Sughrue Mion, PLLC

(57) ABSTRACT

An exposure system is provided with a light emitting element array formed by a plurality of light emitting elements formed at the intersections of anodes and cathodes arranged in matrix so that a photosensitive material is exposed to an image formed on the light emitting element array. A method of driving the light emitting element array includes the steps of driving the light emitting elements in constant-current drive before and/or during an exposure period, measuring and storing in a memory means the anode voltage of each light emitting element at that time, and driving the light emitting elements in constant-voltage drive at a voltage equal to the measured anode voltage at least during beginning of the subsequent exposure periods.

6 Claims, 10 Drawing Sheets

80
81
TIMING GENERATION/
DAC WRITE CONTROL
SRLD
83
12bit 480step SHIFT REGISTER
84
12bit PWM×480ch
PWMout
85
ANODE DRIVER×480ch
82
CURRENT/
VOLTAGE
SETTING DAC
480
3
2
1
21
23
1P
N+1
N
N-1
86
CATHODE
DRIVER
Line Sel
87
LINE
COUNTER
&
DECODER
×3ch
ADR
WR
Shift CLK
12bit Data
PWM CLK
LineCLK
LineCLR DRIVE VOLTAGE SWITHING PERIOD
DRIVE VOLTAGE MEASURING PERIOD
(N-1) LIGHT EMITTING PERIOD
N LIGHT EMITTING PERIOD
(N+1) LIGHT EMITTING PERIOD
CV
CI
ON
OFF
GND
Voff
N-1
N
N+1
N DRIVE VOLTAGE
(N+1) DRIVE VOLTAGE
(N-1) DRIVE VOLTAGE
(1) S1n
(2) S2n
(3) S31
(4) S32
(5) S33
(6) ANODE
(7) CATHODE
(8) MEASUREMENT PULSE

METHOD OF DRIVING LIGHT EMITTING ELEMENT ARRAY

BACKGROUND OF THE INVENTION

1. Field of the Invention

This invention relates to a method of driving a light emitting element array such as an organic EL (electroluminescent) element array.

2. Description of the Related Art

Conventionally, there has been known an exposure system which comprises a light emitting element array comprising a plurality of two-dimensionally arranged light emitting elements, such as organic EL elements, and a drive circuit which controls the light emitting time (light emitting pulse width) of each of the light emitting elements on the basis of an image data carrying thereon a gradation image and exposes a photosensitive material to an image formed on the light emitting element array on the basis of the image data. An example of such an exposure system is disclosed in U.S. patent Laid-Open No. 20010052926.

As a representative of the light emitting element array, there have been known those of a system so-called a simple matrix system where a light emitting element is formed at each intersection of anodes and cathodes disposed in a two-dimensional matrix and is driven with the anodes and cathodes employed as the scanning electrodes and the signal electrodes.

In the light emitting element array of the simple matrix system, one of the plurality of cathodes which are employed, for instance, as the scanning electrodes is connected to a grounding terminal in sequence to be provided with a ground potential and the plurality of anodes as the signal electrodes are selectively connected to a power source on the basis of image data. With this arrangement, current supplies to the light emitting elements formed at the intersections of one cathode and a plurality of anodes are controlled independently of each other, and emission and non-emission of the light emitting elements are controlled. This state is created in sequence for each cathode with selection and scan of the cathodes, and a two-dimensional image is formed on the light emitting element array. The photosensitive material can be exposed to a two-dimensional image by projecting the image onto the photosensitive material through an imaging optical system.

As the driving systems of such light emitting element arrays, there have been known a constant-voltage drive system where each of the light emitting elements is applied with a constant voltage and a constant-current drive system where each of the light emitting elements is applied with a constant current. The former is excellent in response but is poor in stability due to drop and fluctuation of the forward voltage by change with time of the environment of use or each light emitting element. Whereas the latter is substantially linear in the light emitting intensity versus the drive current, and excellent in stability. Accordingly, recently, the organic EL element array often employs the constant-current drive system.

However, when the constant-current drive system is employed for the light emitting element array of the simple matrix system, there has been known a problem that the rise-up characteristics are bad. The problem will be described in detail, hereinbelow.

The light emitting elements formed at the intersections of the anode and the cathode can be considered as elements comprising a light emitting portion having diode characteristics and a parasitic capacity connected in parallel to the light emitting portion. When such a light emitting element array is driven in the constant-current drive, supposing that the cathodes function as the scanning electrodes, the current should be supplied only to a light emitting element (a selected light emitting element) at the intersection of the selected cathode and the anode out of a plurality of light emitting elements formed on the anode. However due to existence of the parasitic capacity described above, all capacities of the light emitting elements formed on the anode are charged with the constant current when the scanning electrodes are switched and accordingly, it requires a long time for the light emitting element to emit light after its capacity is charged, which deteriorates the rise-up characteristics.

In view of this problem, there has been proposed, in U.S. Pat. No. 5,844,368, a method of improving the rise-up characteristics by providing a period for which the anode and the cathodes are kept at the same potential upon switching of the scanning electrodes so that the parasitic capacity of the selected light emitting element is charged to the cathode off voltage (the anode drive voltage-light emission threshold voltage: generally the anode drive voltage) through the parasitic capacities of the non-selected light emitting elements upon initiation of drive.

Further, there has been proposed, in U.S. Pat. No. 6,201,520, a method of improving the rise-up characteristics by providing a period for which all the anodes and the cathodes are short-circuited to the cathode off voltage source and by switching only the selected scanning electrode to the GND after the period to avoid the charge of the parasitic capacity of the selected light emitting element upon initiation of drive.

In the two approaches, the rise-up time is minimized when the cathode off voltage is equal to the anode voltage of the selected element upon drive. However the anode voltage of each light emitting element upon the constant-current drive is not always constant and the anode voltages of the light emitting elements in one array fluctuate according to the initial difference and/or the change with time of the light emitting elements. Further, the anode voltage can fluctuate according to the temperature conditions. Such fluctuation and/or difference of the anode voltage lead to fluctuation of the rise-up time.

When the cathode off voltage is higher than the anode voltage of the selected element upon drive, the light emission of the light emitting element is increased above the normal value for a while after initiation of constant current drive, whereas when the cathode off voltage is lower than the anode voltage of the selected element upon drive, the light emission of the light emitting element is reduced below the normal value for a while after initiation of constant current drive. Though the fluctuation in the light emission does not give rise to a significant problem when the light emitting element array is used as a display means, the fluctuation in the light emission causes deterioration of the quality the exposed image when the light emitting element array is used as an exposure head. Especially, the difference in the light emission between the elements causes a scoring unevenness extending in a sub-scanning direction to greatly deteriorate the quality of the exposed image when the exposure head and the photosensitive material are moved in the sub-scanning direction (sub-scanning).

SUMMARY OF THE INVENTION

In view of the foregoing observations and description, the primary object of the present invention is to provide a method of driving a light emitting element array forming an exposure system which can realize excellent rise-up characteristics and suppress fluctuation in response and/or light emission of the light emitting elements.

In accordance with the present invention, there is provided a method of driving a light emitting element array for an exposure system which is provided with a light emitting element array formed by a plurality of light emitting elements formed at the intersections of anodes and cathodes arranged in matrix so that a photosensitive material is exposed to an image formed on the light emitting element array, comprising the steps of driving the light emitting elements in constant-current drive before and/or during an exposure period, measuring and storing in a memory means the anode voltage of each light emitting element at that time, and driving the light emitting elements in constant-voltage drive at a voltage equal to the measured anode voltage at least during beginning of the subsequent exposure periods.

In this method, it is preferred that the light emitting elements be driven in the constant-voltage drive only for a predetermined period during the beginning of the exposure period and in a constant-current drive in the exposure period after the predetermined period.

In the case where the light emitting elements are driven in both the constant-voltage drive and the constant-current drive in such a way, it is preferred that the light emitting elements be driven in the constant-voltage drive for a time interval defined by one clock pulse from the time point at which the light emission is initiated when the light emitting elements are driven by a signal pulse-width-modulated according to the image data with the pulse width defined by the number of clocks.

In the method of the present invention, since the light emitting elements are driven in the constant-voltage drive at least during beginning of the subsequent exposure periods, excellent rise-up characteristics can be obtained by virtue of the fact that the constant-voltage drive is excellent in response. Further, since the voltage applied to each of the light emitting elements during the constant-voltage drive is equal to the anode voltage when the light emitting element is driven is the constant-current drive, a constant current is supplied to the light emitting element and accordingly, fluctuation in response and/or light emission of the light emitting elements due to change with time of the environment of use or each light emitting element can be suppressed, whereby high stability can be realized.

When the light emitting elements are driven in the constant-voltage drive only for a predetermined period during the beginning of the exposure period and in the constant-current drive in the exposure period after the predetermined period, the operation of the light emitting element array can be more stabilized. The current-voltage characteristic of the light emitting element can be changed before completion of exposure of one image due to the self-heat generation of the element. However, by driving the light emitting element in the constant-current drive in the exposure period after the predetermined period, the light emission can be prevented from being fluctuated in the exposure period due to the error in the current by the change of the current-voltage characteristic of the light emitting element.

The current-voltage characteristic of the light emitting element can be changed after the anode voltage is measured and before the image exposure is initiated. When the light emitting elements are driven by a signal pulse-width-modulated according to the image data with the pulse width defined by the number of clocks, by driving the light emitting elements in the constant-voltage drive for a very short time interval defined by one clock pulse from the time point at which the light emission is initiated, the light emission can be prevented from being fluctuated in the exposure period due to the error in the current by the change of the current-voltage characteristic of the light emitting element after the very short time interval, whereby adverse influence on the quality of the exposed image can be minimized.

Generally, the rise-up time of the organic EL element is substantially equal to the very short time interval defined by one clock pulse, the result of improving the rise-up characteristics is remarkable even if the light emitting elements is driven in the constant-voltage drive for the very short time interval.

Further, though the steps of driving the light emitting elements in constant-current drive, and measuring the anode voltage of each light emitting element at that time can be executed before and/or during an exposure period, it is preferred from the view point of improving the quality of the exposed image to execute before the exposure period in that fluctuation of the light emission can be prevented over the entire exposure period. Whereas it is preferred from the view point of making higher the exposure processing speed to execute during the exposure period in that the time for the steps need not be additionally provided.

DESCRIPTION OF THE PREFERRED EMBODIMENT

Figure 1:
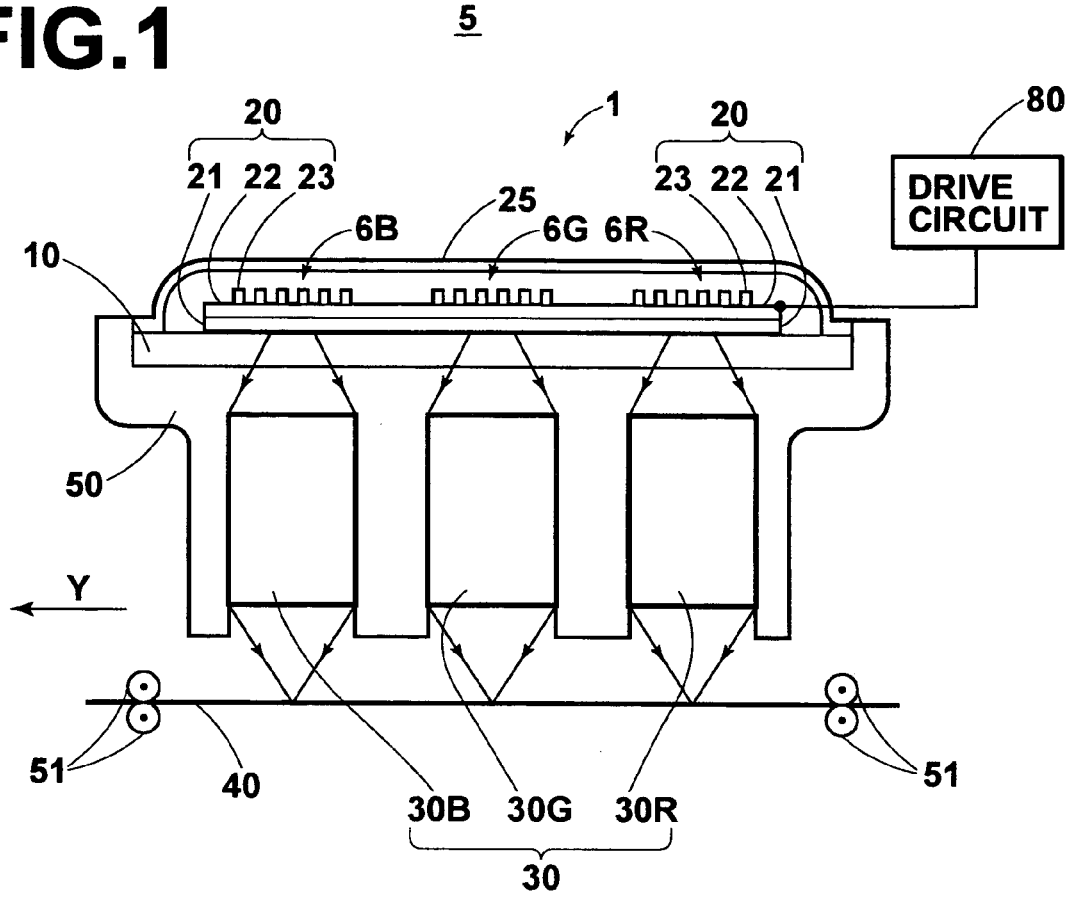
FIG. 1 is a side view showing an example of an exposure system to which a method in accordance with the present invention is applied.

As shown in FIG. 1, an exposure system 5 in accordance with an embodiment of the present invention has an exposure head 1. The exposure head 1 comprises a transparent base 10, a number of organic EL elements 20 formed on the base 10 by deposition, a refractive index profile type lens array 30 (30R, 30G and 30B) which is a unit system for imaging on a color photosensitive sheet 40 an image generated by the light emitted from the organic EL elements 20, and a support 50 which supports the base 10 and the refractive index profile type lens array 30.

The exposure system 5 further comprises, in addition to the exposure head 1, a sub-scanning means 51 in the form of, for instance, a pair of nip rollers which conveys the color photosensitive sheet 40 at a constant speed in a direction of arrow Y.

The organic EL elements 20 comprises a transparent anode 21, an organic compound layer 22 including a light emitting layer and patterned for each pixel and a metal cathode 23 formed in sequence by deposition on a transparent base 10 such as of glass. The elements forming the organic EL elements 20 are arranged in a sealing member 25 which may be, for instance, a can of a stainless steel. That is, the base 10 is bonded to the edge of the sealing member 25 by adhesive and the organic EL elements 20 are sealed in the sealing member 25 filled with dry nitrogen gas.

When a predetermined voltage is imparted between the transparent anode 21 and the metal cathode 23, the light emitting layer included in the organic compound layer 22 emits light, which is taken out through the transparent anode 21 and the transparent base 10. The organic EL element 20 is excellent in wavelength stability. The arrangement of the organic EL elements 20 will be described in detail later.

The transparent anode 21 is preferably not lower than 50% and more preferably not lower 70% in transmittance to visible light in the wavelength range of 400 nm to 700 nm, and may be of known material such as tin oxide, indium.tin oxide (ITO), indium.zinc oxide, and the like. Film of metal such as gold, platinum or the like which is large in work function may be employed as the transparent anode. Further, the transparent anode 21 may be of an organic compound such as polyaniline, polythiophene, polypyrrole or a derivative of these compounds. Transparent conductive films are discussed in detail in "New development of transparent conductive material" supervised by Yutaka Sawada, CMC, 1999, and those shown therein may be applied to the present invention. Further, the transparent anode 21 may be formed on the base 10 by vacuum deposition, sputtering or ion plating.

The organic compound layer 22 may either be of a single layer of the light emitting layer or may be provided with, in addition to the light emitting layer, a hole injecting layer, a hole transfer layer, an electron injecting layer and/or an electron transfer layer, as desired. For example, the organic compound layer 22 and the electrodes may comprise an anode/a hole injecting layer/a hole transfer layer/a light emitting layer/an electron transfer layer/a cathode, an anode/a light emitting layer/an electron transfer layer/a cathode, or an anode/a hole transfer layer/a light emitting layer/an electron transfer layer/a cathode. Further, each of the light emitting layer, the hole transfer layer, the hole injecting layer and the electron injecting layer may be provided in a plurality of layers.

The metal cathode 23 is preferably formed of metal material which is small in work function, e.g., alkaline metal such as Li or K, or alkaline earth metal such as Mg or Ca, or alloy or mixture of these metals with Ag or Al. In order for the shelf stability and the electron-injectability at the cathode to be compatible with each other, the electrode formed of material described above may be coated with metal which is large in work function and high in conductivity, e.g., Ag, Al Au or the like. The metal cathode 23 may be formed by a known method such as vacuum deposition, sputtering or ion plating as the transparent anode 21.

Figure 2:
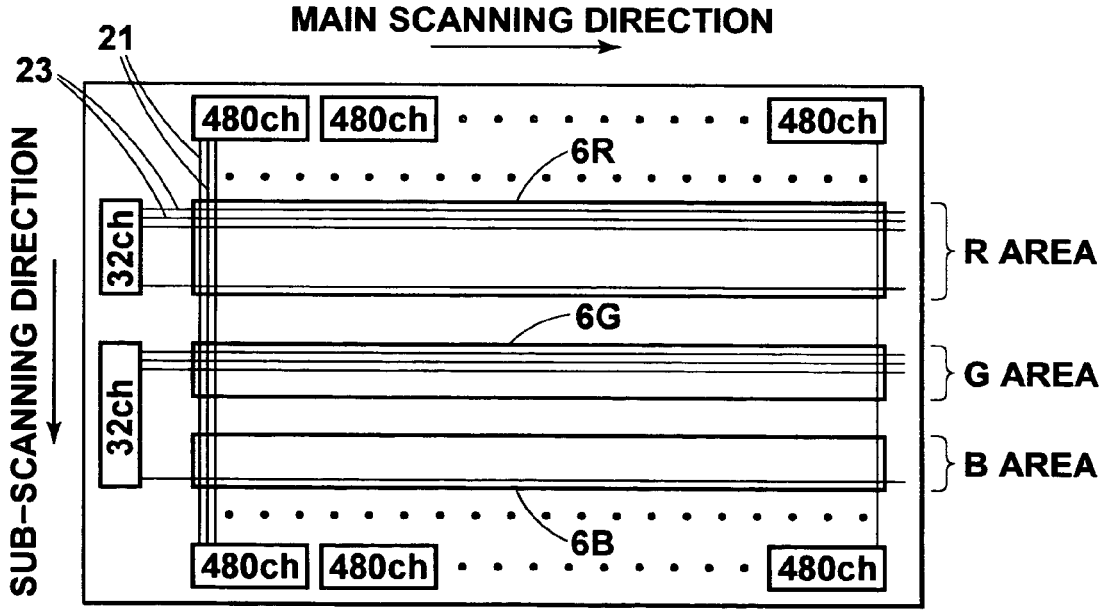
FIG. 2 is a schematic plan view of the exposure head of the exposure system.

Arrangement of the organic EL elements 20 will be described in detail, hereinbelow. FIG. 2 is a view showing the arrangement of the transparent anodes 21 and the metal cathodes 23 in the exposure head 1. As shown in FIG. 2, each of the transparent anodes 21 is patterned into a predetermined shape extending substantially in the sub-scanning direction and common to the organic EL elements 21 arranged in this direction. In this particular embodiment, 3840(=480×8) of the transparent anodes 21 are arranged in the main scanning direction. Each of the metal cathodes 23 linearly extends in the main scanning direction and common to the organic EL elements 21 arranged in this direction. In this particular embodiment, 64 of the metal cathodes 23 are arranged in the sub-scanning direction.

The transparent anodes 21 and the metal cathodes 23 respectively form column electrodes and row electrodes and a predetermined voltage is imparted by a drive circuit 80 shown in FIG. 1 between the transparent anode 21 selected according to the image signal and the metal cathode 23. When a voltage is imparted between one of the transparent anode 21 and one of the metal cathode 23, the light emitting layer included in the organic compound layer 22 disposed at the intersection of the transparent anode 21 and the metal cathode 23 applied with the voltage emits light and the light is taken out through the transparent base 10. That is, in this embodiment, one organic EL element 20 is formed at each of the intersections of the transparent anode 21 and the metal cathode 23 and a plurality of organic EL elements are arranged in the main scanning direction at predetermined pitches to form a linear emitting element array with a plurality of the linear light emitting element arrays are arranged in the sub-scanning direction to form a surface emitting element array.

As can be understood from the description above, a so-called passive matrix drive system is employed in this embodiment. Drive of the passive matrix drive system will be described in detail later.

In this particular embodiment, the exposure head 1 is adapted to exposure of a full color latent image, for instance, to a halogenated silver color photosensitive sheet 40. The arrangement for this purpose will be described in detail, hereinbelow.

The organic EL elements 20 comprises those emitting red light, green light and blue light according to the composition of the light emitting layer included in the organic compound layer 22. In order to separate the organic EL elements according to the color of light emitted from the organic EL elements, those emitting red light, green light and blue light are sometimes referred to as "the organic EL element 20R", "the organic EL element 20G", and "the organic EL element 20B", respectively, hereinbelow.

The organic EL elements 20R are disposed in R area in FIG. 2. 3840 organic EL elements 20R are arranged in the main scanning direction to form one linear red light emitting element array and 32 linear red light emitting element arrays form a surface red light emitting element array 6R.

The organic EL elements 20G are disposed in G area in FIG. 2. 3840 organic EL elements 20G are arranged in the main scanning direction to form one linear green light emitting element array and 16 linear green light emitting element arrays form a surface green light emitting element array 6G.

The organic EL elements 20B are disposed in B area in FIG. 2. 3840 organic EL elements 20B are arranged in the main scanning direction to form one linear blue light emitting element array and 16 linear blue light emitting element arrays form a surface blue light emitting element array 6B.

However, in FIG. 1, only six linear light emitting element arrays are shown to form each surface light emitting element array for the purpose of simplicity.

In the exposure system 5 shown in FIG. 1, when the color photosensitive sheet 40 is to be image-wise exposed, the surface red light emitting element array 6R, the surface green light emitting element array 6G, and the surface blue light emitting element array 6B of the exposure head 1 are selectively driven by the drive circuit 80 according respectively to red image data, green image data, and blue image data while the sub-scanning means 51 conveys the color photosensitive sheet 40 in the sub-scanning direction shown by arrow Y at a constant speed.

At this time, an image by red light from the 32 linear red light emitting element arrays of surface red light emitting element array 6R, an image by green light from the 16 linear green light emitting element arrays of the surface green light emitting element array 6G, and an image by blue light from the 16 linear blue light emitting element arrays of surface blue light emitting element array 6B, are respectively imaged on the color photosensitive sheet 40 in a unit magnification by the refractive index profile type lens arrays 30R, 30G and 30B. With this, the areas exposed to the red light from the 32 linear red light emitting element arrays are then exposed to the green light from the 16 linear green light emitting element arrays and then exposed to the blue light from the 16 linear blue light emitting element arrays. The full color main scanning lines each thus formed are arranged side by side in the sub-scanning direction, whereby the color photosensitive sheet 40 is recorded with a two-dimensional full color image.

The refractive index profile type lens array 30R may comprise SELFOC® lenses each opposed to one organic EL element 20R. The other refractive index profile type lens arrays 30G and 30B are similar to the refractive index profile type lens array 30R.

Figure 3:
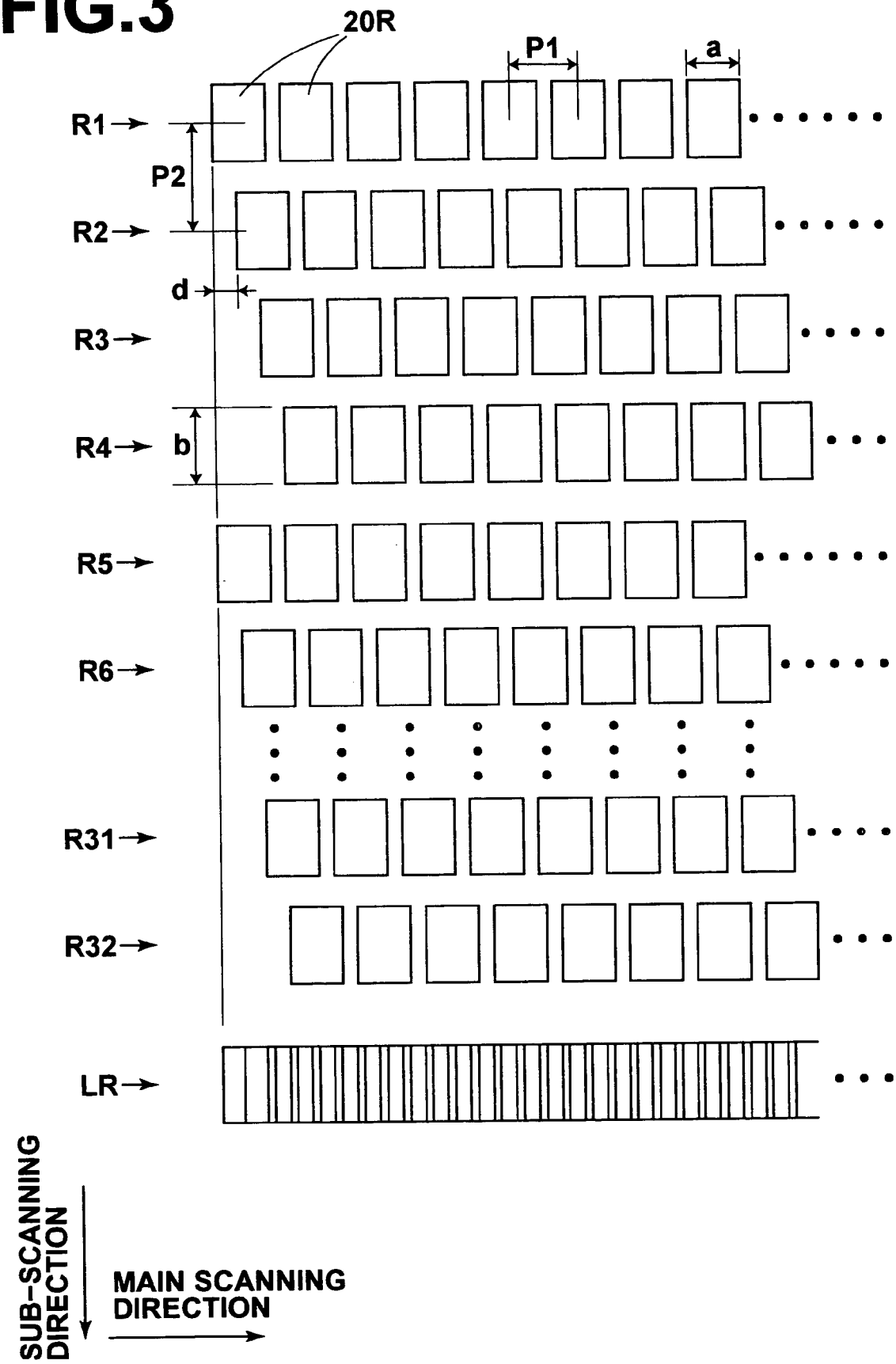
FIG. 3 is a plan view showing the arrangement of the red light emitting elements in the exposure head.

The surface red light emitting element array 6R, the surface green light emitting element array 6G, and the surface blue light emitting element array 6B will be described in more detail, hereinbelow. First the surface red light emitting element array 6R will be described, with reference to FIG. 3. The 32 linear red emitting element arrays forming the surface red light emitting element array 6R are indicated at R1, R2, R3 . . . R32 and the arrangement of the 32 linear red light emitting element arrays R1, R2, R3 . . . R32 is shown in FIG. 3. As shown in FIG. 3, the organic EL elements 20R forming the 32 linear red light emitting element arrays R1, R2, R3 . . . R32 are all a and b respectively in the main and sub-scanning directions and are all arranged at pitches of P1 and P2 respectively in the main and sub-scanning directions.

The starting points of the second to fourth linear red light emitting element arrays R2, R3 and R4 are shifted in the main scanning direction with respect to that of the first linear red light emitting element array R1 by the distances d, 2*d* and 3*d* respectively. The starting point of the fifth linear red light emitting element array R5 is aligned with the first linear red light emitting element array R1 in the main scanning direction, and the sixth to eighth red emitting element arrays R6, R7 and R8 are shifted in the main scanning direction with respect to that of the fifth linear red emitting element array R5 by the distances d, 2*d* and 3*d*, respectively. Thus, the starting points of the every fourth linear red light emitting element arrays are aligned with each other in the main scanning direction and three linear red light emitting element arrays following the every fourth linear red light emitting elements array are shifted in their starting points in the main scanning direction with respect to the starting point of the every fourth linear red light emitting element arrays by the distances d, 2*d* and 3*d*, respectively. Accordingly, the main scanning line on the photosensitive material 40 exposed to the red light comprises a plurality of pixels arranged at pitches ¼ of the pitches P1 at which the organic EL elements 20R are arranged in the main scanning direction as indicated at LR in FIG. 3.

As can be seen from the description above, the first pixel of the main scanning line LR is exposed to the light from the first organic EL elements 20R of the first, fifth, ninth, thirteenth, seventeenth, twenty-first, twenty-fifth and twenty-ninth linear red light emitting element arrays R1, R5, R9, R13, R17, R21, R25 and R29, the second pixel of the main scanning line LR is exposed to the light from the first organic EL elements 20R of the second, sixth, tenth, fourteenth, eighteenth, twenty-second, twenty-sixth and thirtieth linear red light emitting element arrays R2, R6, R10, R14, R18, R22, R26 and R30, the third pixel of the main scanning line LR is exposed to the light from the first organic EL element 20R of the third, seventh, eleventh, fifteenth, nineteenth, twenty-third, twenty-seventh and thirty-first linear red light emitting element arrays R3, R7, R11, R15, R19, R23, R27 and R31, the fourth pixel of the main scanning line LR is exposed to the light from the first organic EL elements 20R of the fourth, eighth, twelfth, sixteenth, twentieth, twenty-fourth, twenty-eighth and thirty-second linear red light emitting element arrays R4, R8, R12, R16, R20, R24, R28 and R32, and the fifth pixel of the main scanning line LR is exposed to the light from the second organic EL elements 20R of the first, fifth, ninth, thirteenth, seventeenth, twenty-first, twenty-fifth and twenty-ninth linear red light emitting element arrays R1, R5, R9, R13, R17, R21, R25 and R29. In a similar manner, each pixel of the main scanning line LR is exposed to the light from eight organic EL elements 20R, and the eight organic EL elements 20R are driven to emit light in a pulse-like fashion, and for instance, by controlling the pulse width, gradation can be generated for each pixel and the color photosensitive material 40 can be recorded with a continuous gradation image.

The amount of light from the organic EL element 20R to which the color photosensitive material 40 is exposed is maximized at a part opposed to the center of the organic EL element 20R and is smaller at a part opposed to the edge of the same. Accordingly, if a main scanning line is exposed to light from one linear red light emitting element array, the exposure greatly fluctuates along the main scanning direction periodically corresponding to the pitches of the organic EL elements 20R. When the periodic fluctuation in exposure (ripple) is significant, an exposure unevenness can be generated.

In order to deal with this problem, the linear red light emitting element arrays are positioned so that the organic EL elements 20R in each of the linear red light emitting element arrays are shifted from the corresponding organic EL elements 20R in the other linear red light emitting element arrays in the main scanning direction with the organic EL elements 20R in each of the linear red light emitting element arrays at least partly overlapping with the corresponding organic EL elements 20R in the other linear red light emitting element arrays in the main scanning direction. That is, with this arrangement, the periodic fluctuation characteristics in exposure to the light from the elements of a given linear red light emitting element array is shifted from the periodic fluctuation characteristics in exposure to the light from the elements of the linear red light emitting element array adjacent to the given array in the main scanning direction and partly overlapped with the same on one main scanning line to be exposed a plurality of times by a plurality of linear red light emitting element arrays. Accordingly, the part which is exposed to light from the element of a given linear red light emitting element array in a smaller amount is exposed to light from the element of the adjacent linear red light emitting element array in a larger amount, whereby the periodic fluctuation characteristics in exposure cancels and occurrence of the exposure unevenness in the main scanning direction is prevented. The technology for suppressing periodic fluctuation is discussed in detail in U.S. Patent Laid-Open No. 20010052926.

Figure 4:
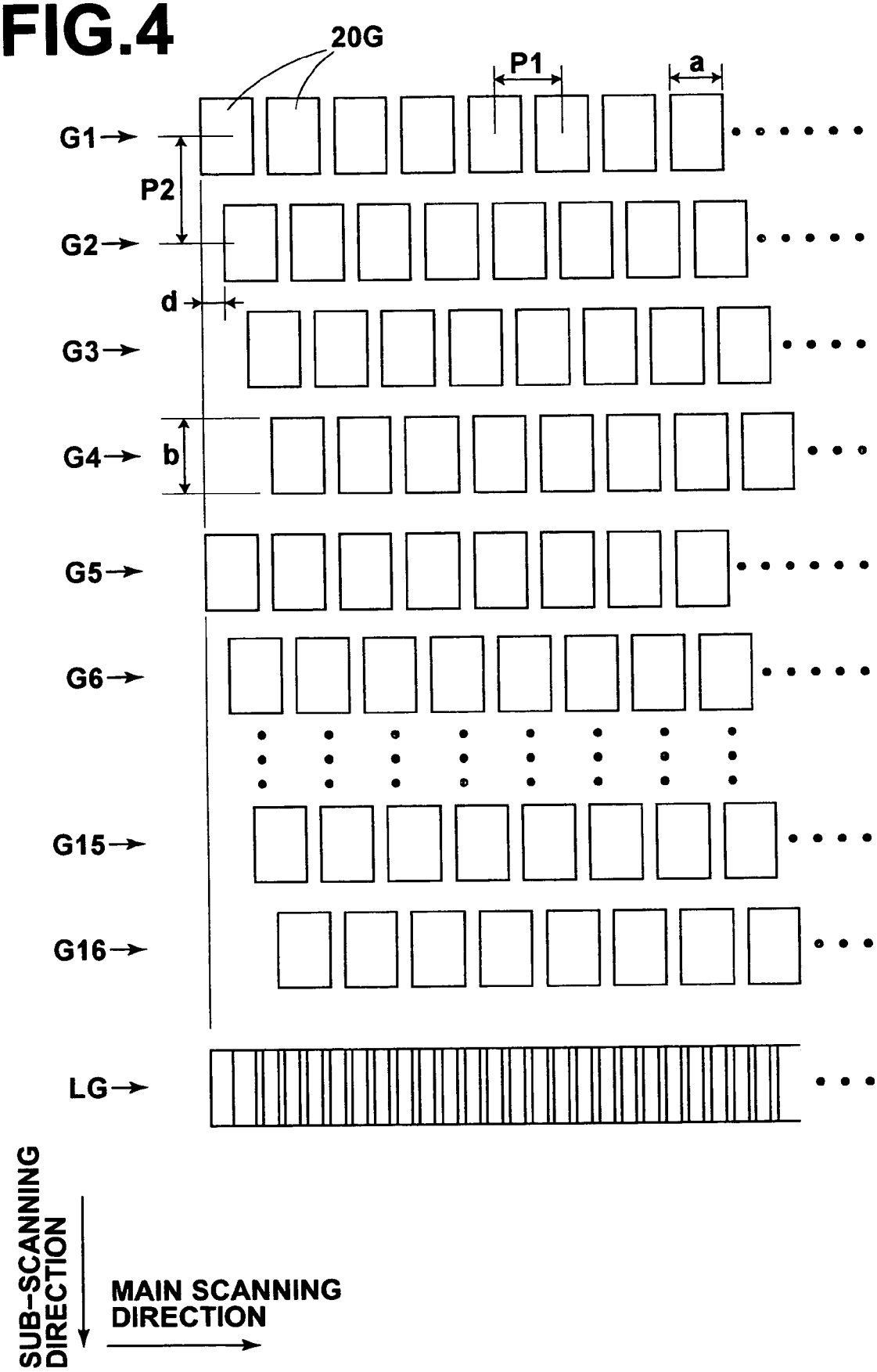
FIG. 4 is a plan view showing the arrangement of the green light emitting elements in the exposure head.

Next the surface green light emitting element array 6G will be described, with reference to FIG. 4. The 16 linear green light emitting element arrays forming the surface green light emitting element array 6G are indicated at G1, G2, G3 . . . G16 and the arrangement of the 16 linear green light emitting element arrays G1, G2, G3 . . . G16 is shown in FIG. 4. As shown in FIG. 4, the organic EL elements 20R forming the 16 linear green light emitting element arrays G1 to G16 are all a and b respectively in the main and sub-scanning directions and are all arranged at pitches of P1 and P2 respectively in the main and sub-scanning directions. That is, the organic EL elements 20R forming the linear green light emitting element arrays G1 to G16 are same as the organic EL elements 20R forming the linear red light emitting element arrays R1 to R32 in size and pitches of arrangement.

The starting points of the second to fourth linear green light emitting element arrays G2, G3 and G4 are shifted in the main scanning direction with respect to that of the first linear green light emitting element array G1 by the distances d, 2*d* and 3*d* respectively. The starting point of the fifth linear green light emitting element array G5 is aligned with the first linear green light emitting element array G1 in the main scanning direction, and the sixth to eighth green light emitting element arrays G6, G7 and G8 are shifted in the main scanning direction with respect to that of the fifth linear green light emitting element array G5 by the distances d, 2*d* and 3*d*, respectively. Thus, the starting points of the every fourth linear green light emitting element arrays are aligned with each other in the main scanning direction and three linear red light emitting element arrays following the every fourth linear red light emitting element arrays are shifted in their starting points in the main scanning direction with respect to the starting points of the every fourth linear red light emitting element arrays by the distances d, 2*d* and 3*d*, respectively. Accordingly, the main scanning line on the photosensitive material 40 exposed to the green light comprises a plurality of pixels arranged at pitches ¼ of the pitches P1 at which the organic EL elements 20G are arranged in the main scanning direction as indicated at LG in FIG. 4.

As can be seen from the description above, the first pixel of the main scanning line LG is exposed to the light from the first organic EL elements 20G of the first, fifth, ninth and thirteenth linear green light emitting element arrays G1, G5, G9 and G13, the second pixel of the main scanning line LG is exposed to the light from the first organic EL elements 20R of the second, sixth, tenth and fourteenth linear green light emitting element arrays G2, G6, G10 and G14, the third pixel of the main scanning line LG is exposed to the light from the first organic EL element 20G of the third, seventh, eleventh and fifteenth linear green light emitting element arrays G3, G7, G11 and G15, the fourth pixel of the main scanning line LG is exposed to the light from the first organic EL elements 20R of the fourth, eighth, twelfth and sixteenth linear green light emitting element arrays G4, G8, G12 and G16, and the fifth pixel of the main scanning line LG is exposed to the light from the second organic EL elements 20G of the first, fifth, ninth and thirteenth linear green light emitting element arrays G1, G5, G9 and G13. In a similar manner, each pixel of the main scanning line LG is exposed to the light from four organic EL elements 20G.

Drive of the organic EL elements 20G and suppression of the periodic fluctuation in exposure (ripple) in the main scanning direction in the surface green light emitting element array 6G are the same in the above surface red light emitting element array 6R.

Figure 5:
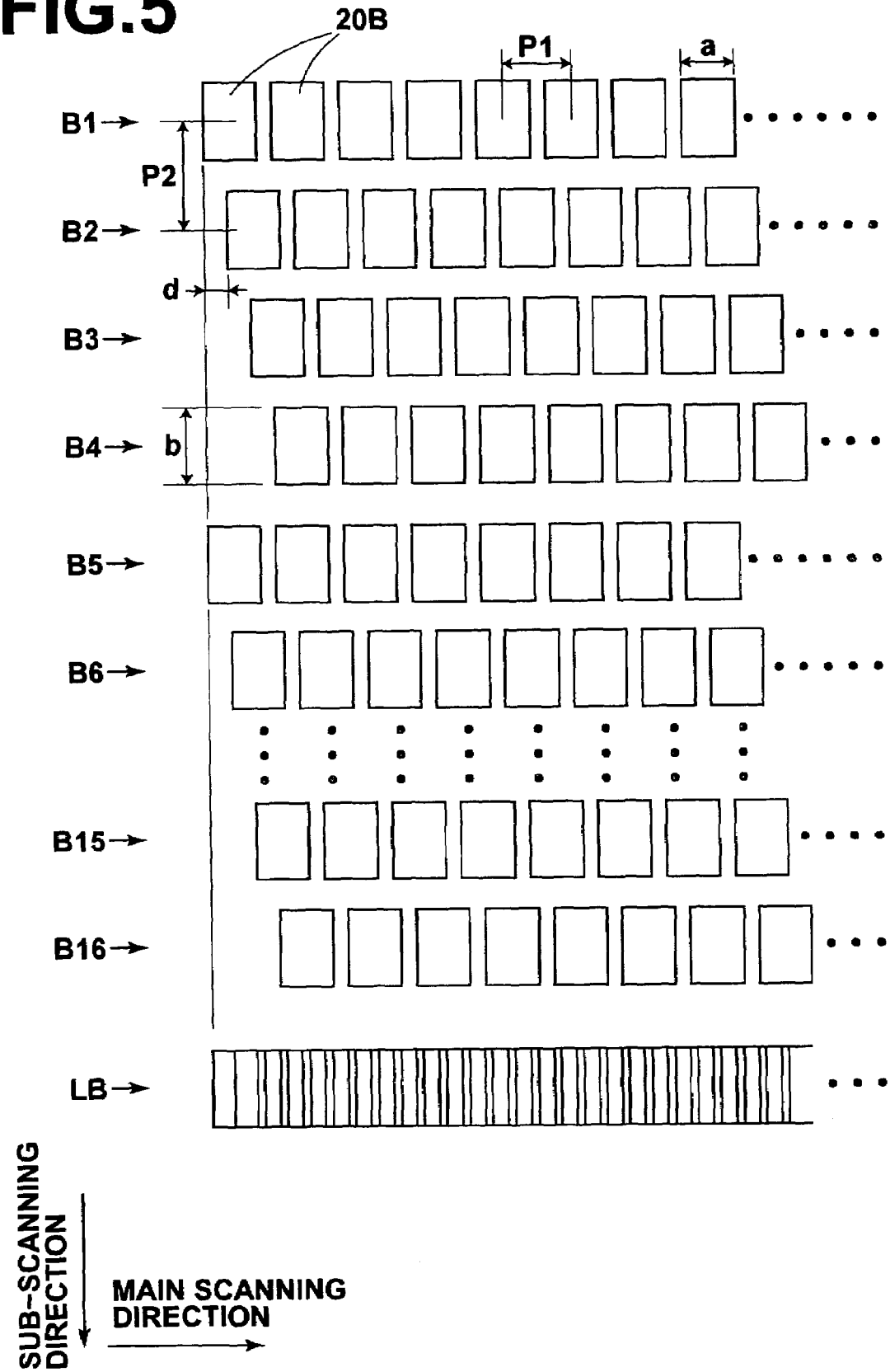
FIG. 5 is a plan view showing the arrangement of the blue light emitting elements in the exposure head.

Next the surface blue light emitting element array 6G will be described, with reference to FIG. 5. The 16 linear blue light emitting element arrays forming the surface blue light emitting element array 6G are indicated at B1, B2, B3 . . . B16 and the arrangement of the 16 linear blue light emitting element arrays B1, B2, B3 . . . B16 is shown in FIG. 5. As shown in FIG. 5, the organic EL elements 20B forming the 16 linear green light emitting element arrays B1 to B16 are all a and b respectively in the main and sub-scanning directions and are all arranged at pitches of P1 and P2 respectively in the main and sub-scanning directions. That is, the organic EL elements 20B forming the linear green light emitting element arrays G1 to G16 are same as the organic EL elements 20R and 20G in size and pitches of arrangement.

The starting points of the second to fourth linear green light emitting element arrays G2, G3 and G4 are shifted in the main scanning direction with respect to that of the first linear green light emitting element array G1 by the distances d, 2*d* and 3*d* respectively. The starting point of the fifth linear green light emitting element array G5 is aligned with the first linear green light emitting element array G1 in the main scanning direction, and the sixth to eighth green light emitting element arrays G6, G7 and G8 are shifted in the main scanning direction with respect to that of the fifth linear green light emitting element array G5 by the distances d, 2*d* and 3*d*, respectively. Thus, the starting points of the every fourth linear green light emitting element arrays are aligned with each other in the main scanning direction and three linear red light emitting element arrays following the every fourth linear red light emitting element arrays are shifted in their starting points in the main scanning direction with respect to the starting points of the every fourth linear red light emitting element arrays by the distances d, 2*d* and 3*d*, respectively. Accordingly, the main scanning line on the photosensitive material 40 exposed to the green light comprises a plurality of pixels arranged at pitches ¼ of the pitches P1 at which the organic EL elements 20B are arranged in the main scanning direction as indicated at LB in FIG. 5.

As can be seen from the description above, the first pixel of the main scanning line LB is exposed to the light from the first organic EL elements 20B of the first, fifth, ninth and thirteenth linear blue light emitting element arrays B1, B5, B9 and B13, the second pixel of the main scanning line LB is exposed to the light from the first organic EL elements 20R of the second, sixth, tenth and fourteenth linear blue light emitting element arrays B2, B6, B10 and B14, the third pixel of the main scanning line LB is exposed to the light from the first organic EL element 20B of the third, seventh, eleventh and fifteenth linear blue light emitting element arrays B3, B7, B11 and B15, the fourth pixel of the main scanning line LB is exposed to the light from the first organic EL elements 20R of the fourth, eighth, twelfth and sixteenth linear blue light emitting element arrays G4, G8, G12 and G16, and the fifth pixel of the main scanning line LG is exposed to the light from the second organic EL elements 20G of the first, fifth, ninth and thirteenth linear blue light emitting element arrays B1, B5, B9 and B13. In a similar manner, each pixel of the main scanning line LB is exposed to the light from four organic EL elements 20B.

Drive of the organic EL elements 20B and suppression of the periodic fluctuation in exposure (ripple) in the main scanning direction in the surface blue light emitting element array 6B are the same in the above surface red light emitting element array 6R.

Figure 6:
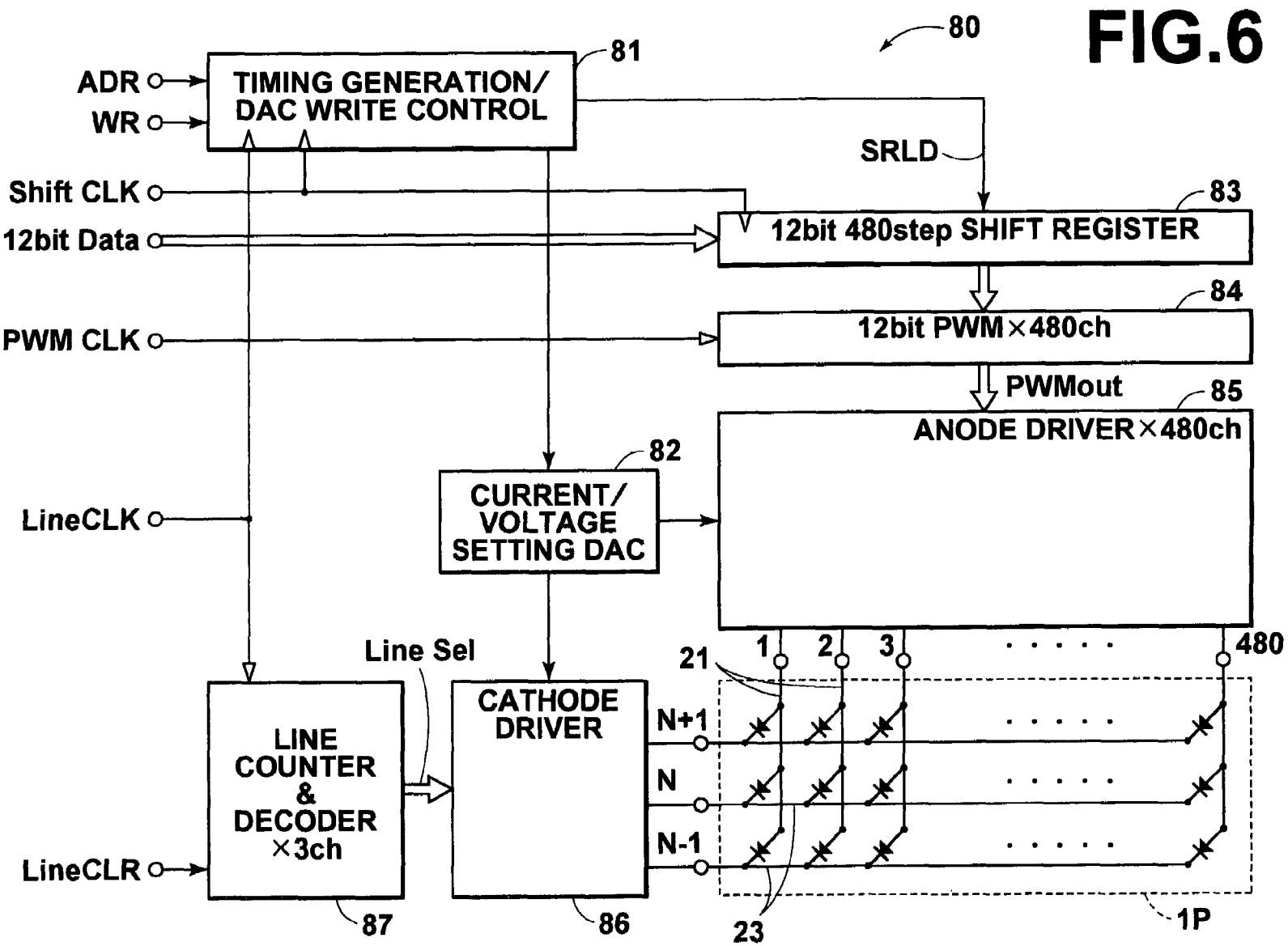
FIG. 6 is a block diagram showing the arrangement of the drive circuit of the light emitting elements of the exposure system.
Figure 7:
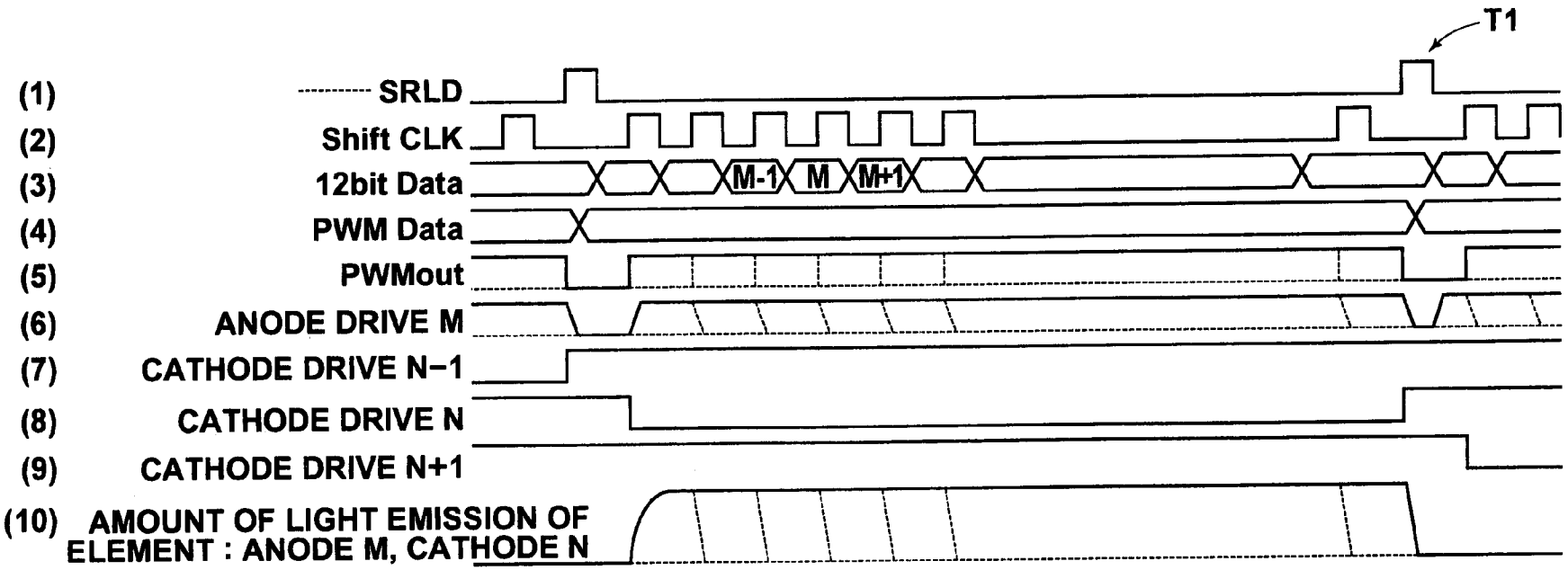
FIG. 7 is a view showing waveforms of the various signals in the drive circuit.

Drive of the exposure head 1 by the drive circuit 80 will be described in detail with reference to FIGS. 6 and 7, hereinbelow. FIG. 6 is a block diagram showing the arrangement of the drive circuit 80 and FIG. 7 shows waveforms of the various signals in the drive circuit 80 ((1) to (9)) and the light emitting characteristic of the organic EL element 20 corresponding to the waveforms of the signals ((10)). In FIG. 6, the part surrounded by broken line 1P shows the organic EL panel forming the exposure head 1 and the remaining part shows the elements forming the drive circuit 80. In FIG. 6, the organic EL panel 1P is provided with 480 transparent anodes 21 and three, (N−1), N, (N+1), metal cathodes 23, and its equivalent circuit is shown. The description below will be made conforming to the illustrated circuit.

The drive circuit 80 is provided with a timing generation/DAC write control portion 81 and DAC selection signal ADR, DAC write signal, shift clock Shift CLK and line clock Line CLK are input into the control portion 81. The control portion 81 controls a current/voltage setting DAC (D/A converter) 82 and a shift register 83 on the basis of the signals. Into the sift register 83, serial load signals SRLD synchronized with the line clock Line CLK are input from the control portion 81 and the shift clock Shift CLK and 12 bit image data Data are input.

The image data Data is serially input into the shift register 83 main scanning line by main scanning line, by data for 480 pixels, and the shift register 83 transfers data for 480 pixels to a PWM (pulse width modulator) portion 84 in parallel at a timing defined by the shift clock Shift CLK each time the serial load signal SRLD is input. The waveforms of the serial load signal SRLD, the shift clock Shift CLK and the image data Data are shown in FIG. 7 ((1), (2) and (3)).

The PWM portion 84 outputs a voltage signal PMWout the pulse width of which corresponds to each image data components making up the image data Data for each of the 480 pixels to an anode driver 85 on the basis of the clock PWM CLK synchronized with the line clock Line CLK. That is, when the image data component for one of the 480 pixels, for instance, the image data component PWM Data for a Mth pixel on a given main scanning line is as shown at (4) in FIG. 7, the PWM portion 84 outputs a voltage signal PMWout the pulse width of which corresponds to the image data component PWM Data as shown at (5) in FIG. 7. The pulse width of the signal PMWout is defined with the one period of the clock PWM CLK taken as the minimum unit.

Figure 8:
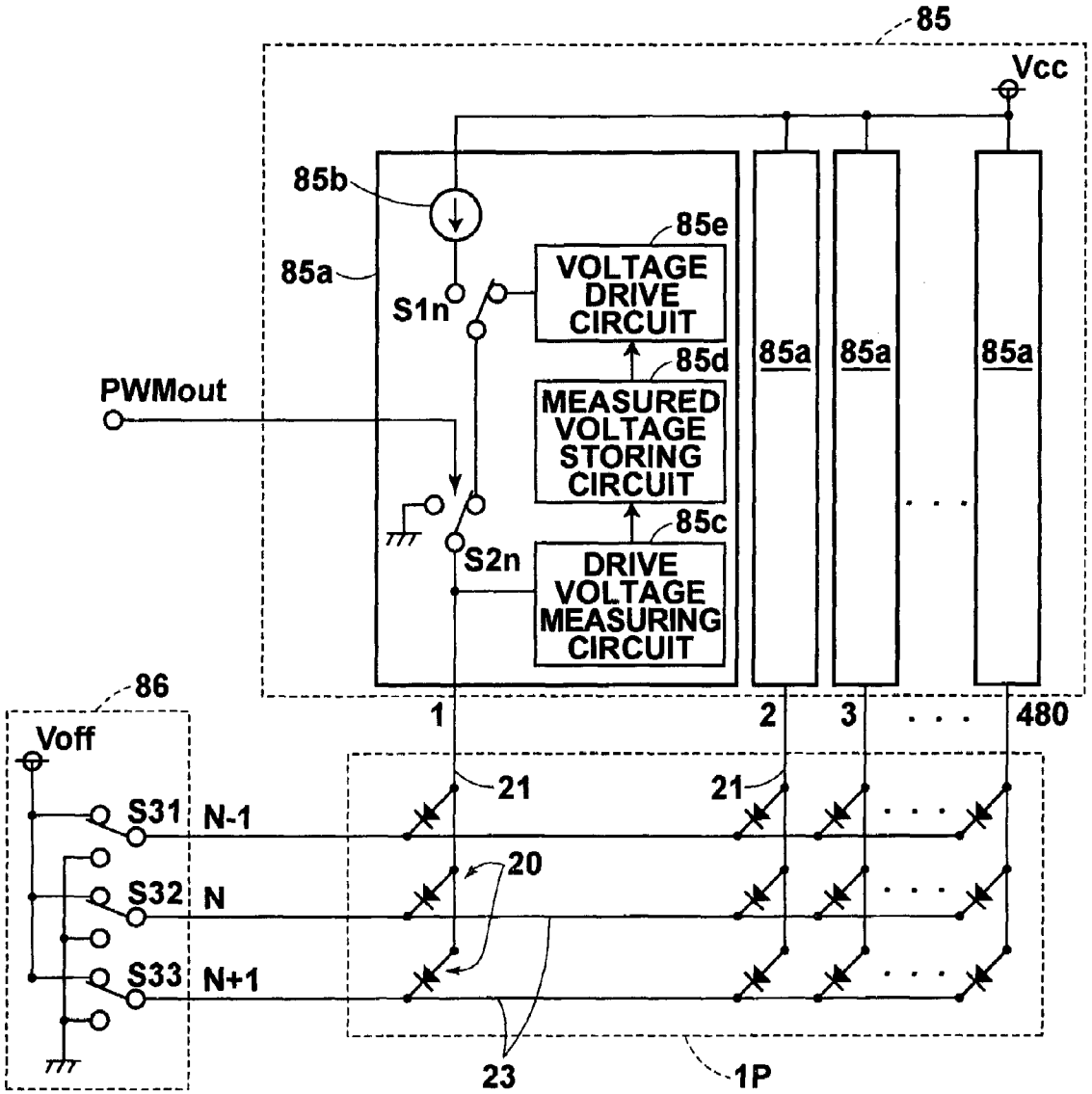
FIG. 8 is a block diagram showing in detail a part of FIG. 6.

The anode driver 85 and the cathode driver 86 are shown in detail in FIG. 8. As shown in FIG. 8, the anode driver 85 has a plurality of drive control portions 85*a* each connected to different one of the 480 transparent anodes 21. Each of the drive control portions 85*a* comprises a constant-current source 85*b*, first and second switching portions S1*n* and S2*n* inserted into a line connecting the constant-current source 85*b* to the transparent anode 21, a drive voltage measuring circuit 85*c* connected to the transparent anode 21, a measured voltage storing circuit 85*d* connected to the drive voltage measuring circuit 85*c*, and a voltage drive circuit 85*e* intervening between the measured voltage storing circuit 85*d* and the first switching portion S1*n*.

When the photosensitive material 40 is to be exposed to an image, the voltage signal PMWout is input into the anode driver 85 and the second switching portion S2*n* connects the transparent anode 21 to the constant-current source 85*b* or the voltage drive circuit 85*e* for a period for which the voltage signal PMWout is kept at the high level. The constant-current source 85*b* and the voltage drive circuit 85*e* are selected by the first switching portion S1*n*. Selection of the constant-current source 85*b* and the voltage drive circuit 85*e* by the first switching portion S1*n* will be described later. The drive waveform for M-th transparent anode 21 at this time is shown at (6) in FIG. 7. Setting of the drive current and the drive voltage by the anode driver 85 is basically governed by the output of the current/voltage setting D/A converter 82.

The metal cathodes 23 are driven in sequence by the cathode driver 86. As shown in FIG. 8, the cathode driver 86 has three switching portions S31, S32 and S33 respectively inserted into lines connected to three metal cathodes 23. A line counter/decoder 87 which receives the line clock Line CLK and a line clear signal Line CLR is connected to the cathode driver 86 as shown in FIG. 6. The metal cathode 23 is grounded so that a current can be supplied to the intersection with the transparent anode 21 for a period for which a voltage signal Line Sel input into one of the switching portions S31, S32 and S33 is kept low. The waveforms of (N−1)-th, N-th and (N+1)-th metal cathodes 23 at this time are shown in FIG. 7 ((7), (8) and (9)). In the illustrated embodiment, N-th metal cathode 23 is in the driven state. The light-emitting waveform of the organic EL element 20 formed at the intersection of N-th metal cathode 23 and M-th transparent anode 21 at this time is shown at (10) in FIG. 7.

In FIG. 7, H-th metal cathode 23 is selectively driven at the timing defined by the serial load signal SRLD shown at (1) and the image data components transferred in parallel from the shift register 83 to the PWM portion 84 for the period for which the 480 transparent anodes 21 are driven as shown at (6) in FIG. 7 are for driving the 480 transparent anodes 21 intersecting the next or (N+1)-th metal cathode 23.

Figure 9:
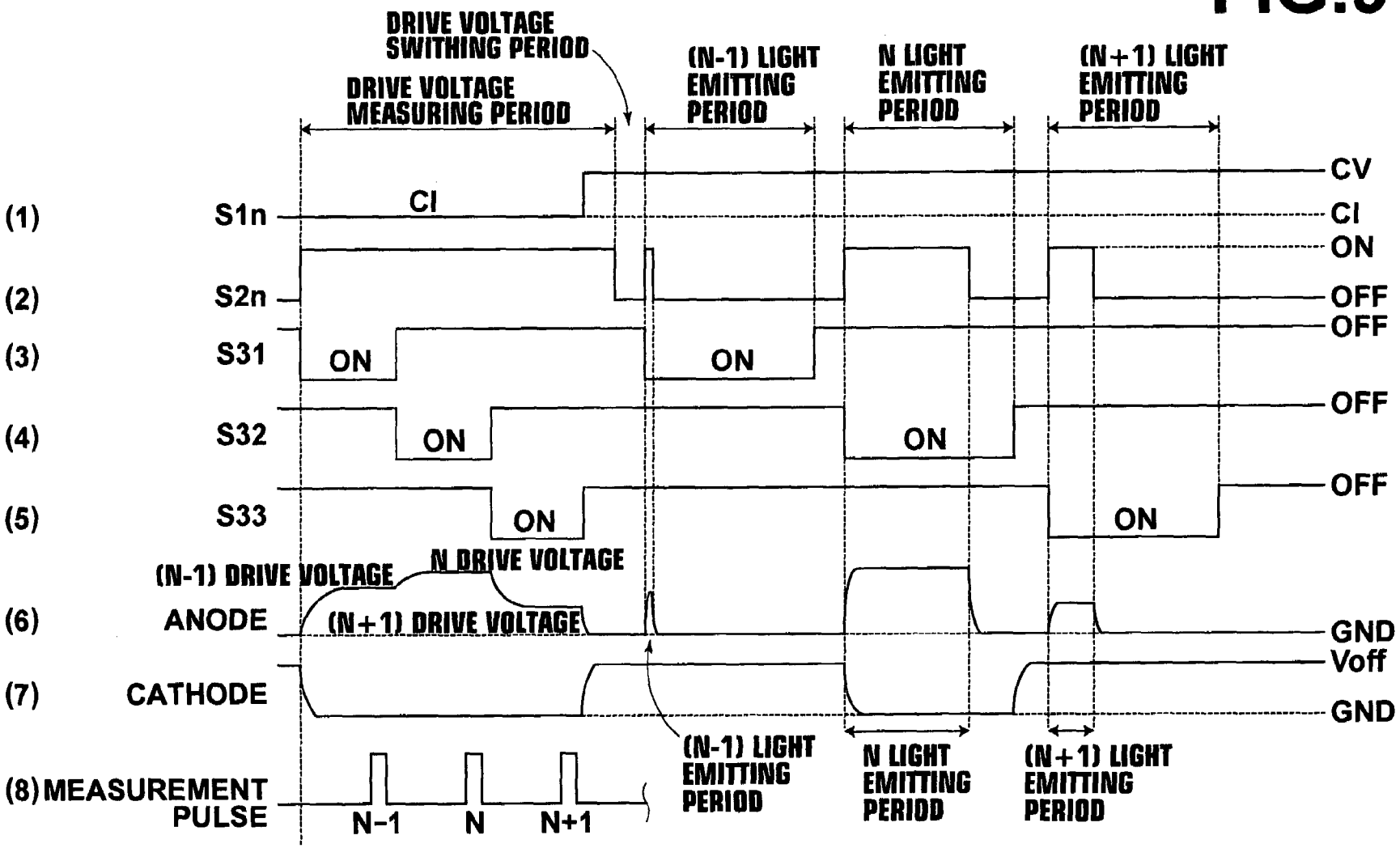
FIG. 9 is a view showing waveforms of the various signals in the circuit shown in FIG. 8.

Improvement of the rise-up characteristics of the organic EL element 20 will be described with reference to also FIG. 9. In FIG. 9, (1), (2), (3), (4) and (5) respectively show the drive waveforms for the switching portions S1*n*, S2*n*, S31, S32 and S33 for one of the transparent anodes 21, (6) and (7) respectively show examples of the anode voltage waveform and the cathode voltage waveform of the organic EL element 20, and (8) shows an example of a measurement pulse which defines the timing at which the anode voltage is measured by the drive voltage measuring circuit 85*c*. The low level state of the first switching portion S1*n* indicated at CI at (1) in FIG. 9 shows a state where the transparent anode 21 is connected to the constant-current source 85*b* for the constant-current drive whereas the high level state of the same indicated at CV at (1) in FIG. 9 shows a state where the transparent anode 21 is connected to the drive voltage measuring circuit 85*c* for the constant-voltage drive.

In this embodiment, before the period of the exposure described above, that is, before the exposure of the color photosensitive material 40 to one image is initiated or, for instance, when the power source of the image exposure system 5 is turned on to raise up the exposure system 5, the switching portion S31 of the cathode driver 86 shown in FIG. 8 is turned on whereas the other switching portions S32 and S33 of the cathode driver 86 are turned off. Thus, (N−1)-th metal cathode 23 is grounded so that a current can be supplied to intersection with the transparent anode 21. At the same time, the second switching portion S2*n* of the anode driver 85 is turned on while the first switching portion S1*n* is set so that the constant-current source 85*b* can be connected to the transparent anodes 21. In this manner, the organic EL elements 20 formed at the intersections of (N−1)-th metal cathode 23 and the 480 transparent anodes 21 are all driven in the constant current drive.

At this time, the anode voltage of each organic EL element is measured by the drive voltage measuring circuit 85*c* which is provided for each of the 480 drive control portions 85*a*. The measured anode voltages are stored in the measured voltage storing circuit 85*d* linked with the number of the selected metal cathode 23 (N−1 in this particular example).

After completion of this processing, the switching portion S31 of the cathode driver 86 is turned off, and the next switching portion S32 is turned on, whereby N-th metal cathode 23 is grounded and the organic EL elements 20 formed at the intersections of N-th metal cathode 23 and the 480 transparent anodes 21 are all driven in the constant current drive. In the same manner as described above, the anode voltage of each organic EL element at this time is measured by the drive voltage measuring circuit 85*c* for each of the 480 drive control portions 85*a*. The measured anode voltages are stored in the measured voltage storing circuit 85*d* linked with the number of the selected metal cathode 23 (N in this particular example).

After completion of this processing, the switching portion S32 of the cathode driver 86 is turned off, and the next switching portion S33 is turned on, whereby (N+1)-th metal cathode 23 is grounded and the organic EL elements 20 formed at the intersections of (N+1) -th metal cathode 23 and the 480 transparent anodes 21 are all driven in the constant current drive. In the same manner as described above, the anode voltage of each organic EL element at this time is measured by the drive voltage measuring circuit 85*c* for each of the 480 drive control portions 85*a*. The measured anode voltages are stored in the measured voltage storing circuit 85*d* linked with the number of the selected metal cathode 23 (N+1 in this particular example).

As can be understood from the description above, the processing described above is actually executed each time the 64 (actually not three) metal cathodes 23 are selected in sequence and the measured anode voltages are stored in the 480 measured voltage storing circuits 85*d* linked with each of the 64 metal cathodes 23.

When the period of the exposure subsequently comes, the 64 metal cathodes 23 are selected in sequence as in measurement of the anode voltage, and the second switching portion S2*n* of the anode driver 85 is on for a period for which the voltage signal PMWout having a pulse width corresponding to the image data PWM Data is kept at the high level, whereby each organic EC element 20 is pulse-width-modulated.

In this exposure period, the first switching portion S1*n* of the anode driver 85 is switched to a state where the transparent anode 21 is connected to the voltage drive circuit 85*e* whereby the organic EL element 20 comes to be driven in the constant-current drive. The drive voltage of each organic EL element 20 in the constant-current drive is set to be equal to the measured anode voltage for the organic EL element 20 stored in the measured voltage storing circuit 85*d*. That is, each organic EL element 20 is driven in the constant-voltage drive at a voltage equal to the anode voltage when the organic EL element 20 is driven in the constant-current drive. Accordingly, a quick rise-up inherent to the constant-voltage drive can be obtained and at the same time, since a constant current is supplied to each organic EL element 20 at this time, fluctuation in response and/or light emission of the organic EL element 20 due to change with time of the environment of use or each organic EL element 20 can be suppressed, whereby high stability can be realized.

Figure 10:
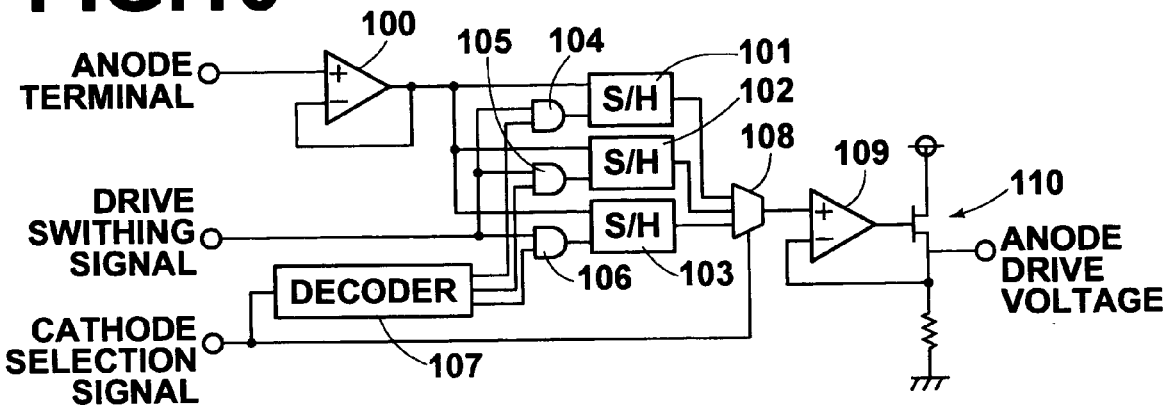
FIG. 10 is a block diagram showing an example of the elements forming the circuit shown in FIG. 8.

The drive voltage measuring circuit 85*c*, the measured voltage storing circuits 85*d* and the voltage drive circuit 85*e* shown in FIG. 8 can be simply formed by the use of, for instance, a sample hold circuit. An example of such an arrangement is shown in FIG. 10. In FIG. 10, such an arrangement for one anode is shown and the number of the cathodes is three for the purpose of convenience. In this arrangement, the output of an operational amplifier 100 as the drive voltage measuring circuit connected to the anode terminal is input into sample hold circuits 101, 102 and 103 in parallel as the anode voltage signal. AND gates 104, 105 and 106 are respectively connected to the sample hold circuits 101, 102 and 103 and a cathode selection signal is input into each of the AND gates 104, 105 and 106 through a decoder 107.

In this arrangement, the cathode selection signal for turning on one of the switching portions S31, S32 and S33 (FIG. 8) in sequence to select the cathode to be driven is input into the decoder 107 and the decoder 107 inputs the cathode selection signal into one of the AND gates 104, 105 and 106 according to the order of input. When a drive switching signal for keeping the first switching portion S1*n* (FIG. 8) at the low level shown in FIG. 9 (that is, for commanding to drive the organic elements 20 in the constant-current drive) has been input into the AND gates 104, 105 and 106 at this time, a sampling command signal is input into the sample hold circuits 101, 102 and 103 from the AND gates 104, 105 and 106 in synchronization with the cathode selection signal in timing, whereby the AND gates 104, 105 and 106 sample-hold the output of the operational amplifier 100 in synchronization with the cathode selection. Though the cathode selection signal is input into the AND gates 104, 105 and 106 even during the exposure period, no sampling command signal is output from the AND gates 104, 105 and 106 since the above drive switching signal is input into the AND gates 104, 105 and 106. In this manner, the sample hold circuits 101, 102 and 103 store the anode voltage for each driven cathode linked with the cathode.

The anode voltages sample-held in this manner are input into an operational amplifier 109 through an analog multiplexer 108 during the subsequent exposure period. The analog multiplexer 108 selects the anode voltage in the order of the sample hold circuits 101, 102 and 103 and outputs it in a time sharing system each time the cathode selection signal is input. With this arrangement, when, for instance, N-th metal cathode 23 is selected during the exposure period, the anode voltage measured for the cathode 23 is input into the operational amplifier 109. The output of the operational amplifier 109 is input an FET (field effect transistor) 110 as a gate voltage, and the source voltage of the FET 110 is taken out as the anode drive voltage during the exposure period.

Assuming that the anode voltage measuring error and the storage error is 10% with the arrangement described above when the pulse-width modulation of the organic EL element 20 is effected in 8 bits (256 levels), the error between the constant current and the constant voltage is 10% of the resolving power of the pulse-width modulation, that is, about 0.04% of the maximum exposure. The error at such a level gives rise to no problem in high quality image exposure.

Another arrangement of the drive voltage measuring circuit 85*c*, the measured voltage storing circuits 85*d* and the voltage drive circuit 85*e* shown in FIG. 8 will be described with reference to FIG. 11, hereinbelow. Also, in FIG. 11, only an arrangement for one anode is shown. In this arrangement, the output of an operational amplifier 100 as the drive voltage measuring circuit connected to the anode terminal is input into an ADC (A/D converter) 120. When a drive switching signal for keeping the first switching portion S1*n* (FIG. 8) at the low level shown in FIG. 9 (that is, for commanding to drive the organic elements 20 in the constant-current drive) has been input into the ADC 120, the ADC 120 samples and digitizes the analog output of the operational amplifier 100 representing the anode voltage in the sampling period corresponding to period of the cathode selection. The digitized anode voltage is stored in an RAM (Random Access Memory) 120 at a predetermined address in correspondence to the sampling order, that is, in correspondence to the selected cathode.

A cathode selection signal is input into the RAM 120 during the subsequent exposure period. The anode voltages are read out from the RAM 120 in the order of addresses each time the cathode selection signal is input into the RAM 120. The anode voltages read out are input into a DAC (D/A converter) 122. The DAC 122 converts the anode voltages to analog signals and inputs them into the operational amplifier 109. Thereafter, the anode drive voltage during the exposure period is taken out from the FET 110 in the same manner as the arrangement shown in FIG. 10.

Figure 11:
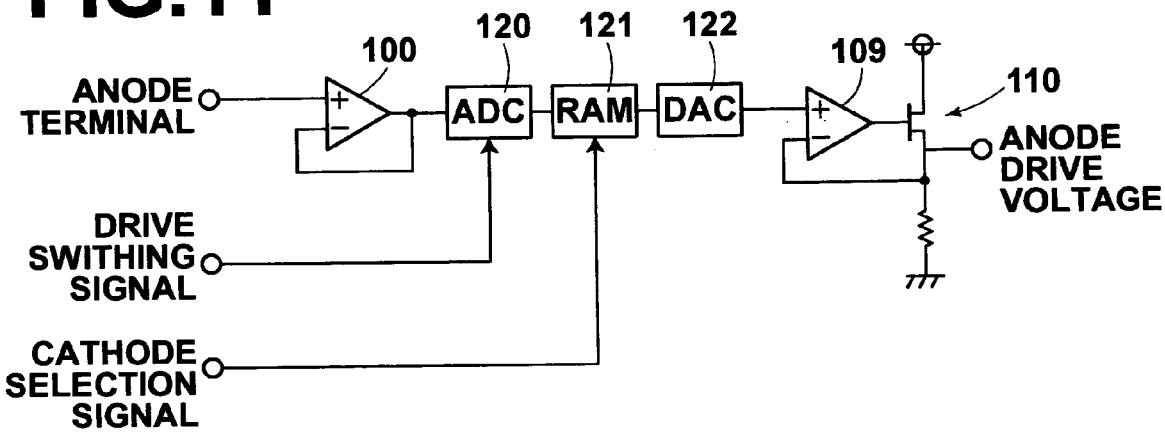
FIG. 11 is a block diagram showing another example of the elements forming the circuit shown in FIG. 8.

Though, in the arrangement shown in FIG. 10, drop in the holding voltages of the sample hold circuits 101, 102 and 103 can give rise to a problem when the number of the cathodes is very large, the arrangement shown in FIG. 11 is free from such a problem.

Measuring the anode voltage of each organic EL element 20 may be executed during the exposure period in place of before the exposure period as in the embodiment described above. In the case where measuring the anode voltage of each organic EL element 20 is executed during the exposure period, the measurement may be carried out either after the completion of the exposure to the light emitted from the organic EL elements 20 or in a predetermined period in the period during which the organic EL elements 20 emit light.

Figure 12:
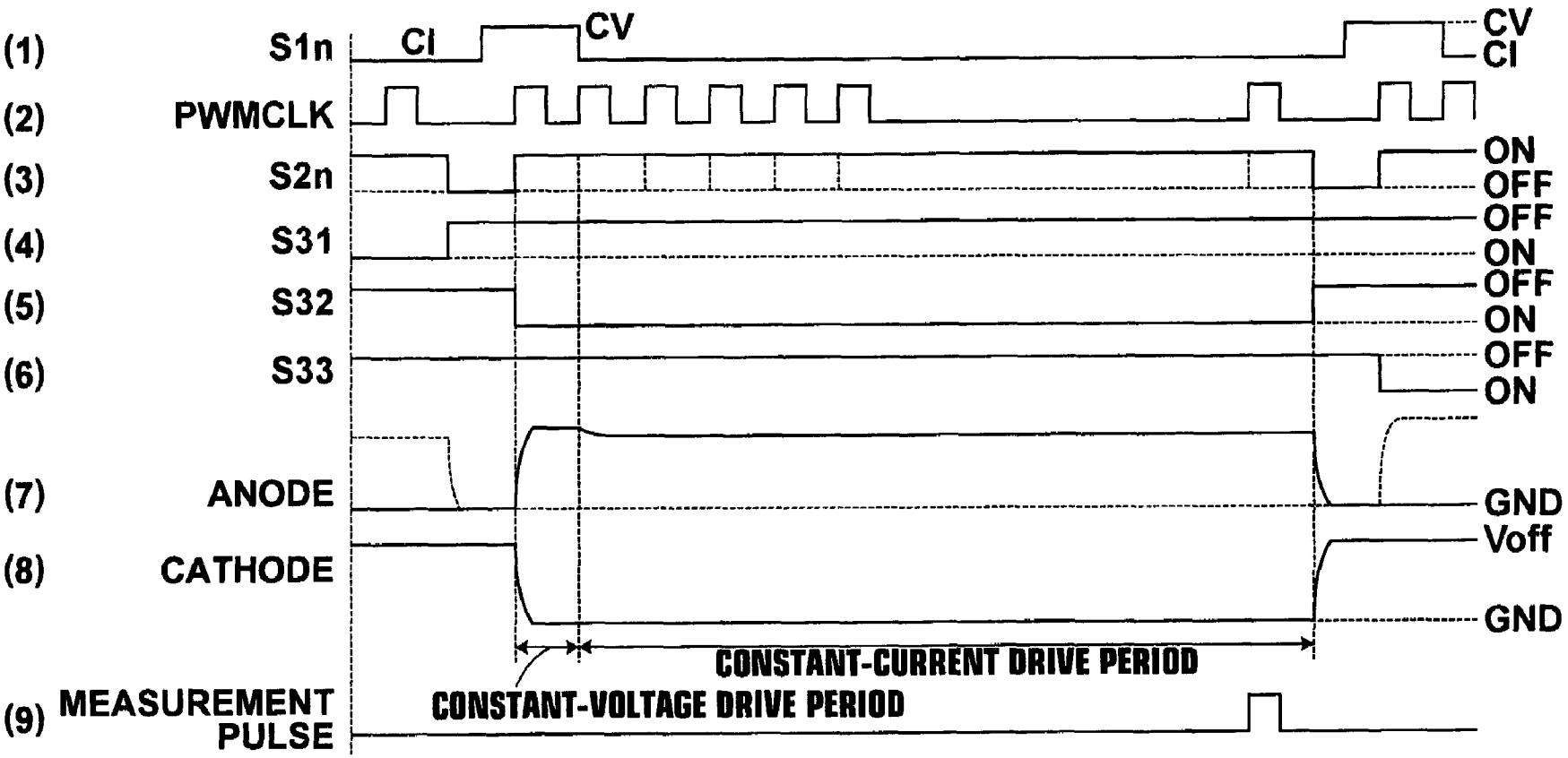
FIG. 12 is a view showing waveforms of the various signals in another embodiment of the present invention.

FIG. 12 shows examples of the drive waveforms of the switching portions S1*n*, S2*n*, S31, S32 and S33 for one transparent anode 21, the waveform of the clock PWM CLK, the waveforms of the anode voltage and the cathode voltage of one organic EL element 20 and the waveform of the measurement pulse for defining the timing at which the anode voltage is to be measured by the drive voltage measuring circuit ((1), (3), (4), (5), (2), (7), (8) and (9)). Signs in FIG. 12 such as "CI" and "CV" bear the same meanings as those in FIG. 9.

The pulse width in the pulse-width-modulation of the organic EL element 20 is also defined with the one period of the clock PWM CLK taken as the minimum unit. That is, when the pulse-width modulation of the organic EL element 20 is effected in 8 bits (256 levels), the period of emission of light of the organic EL element 20 is divided into 255 unit periods (there is a period for which the organic EL element 20 emits no light in addition to the 255 unit periods), and when the organic EL element 20 emits light, the second switching portion S2*n* which has been on is turned off at a border of unit periods.

In this particular embodiment, as the voltage measurement pulse is shown at (9) in FIG. 12, the anode voltage is measured just before the organic EL element 20 terminates emission of light, that is, just before the second switching portion S2*n* is turned off. The anode voltage measuring timing is changed according to the light emitting period defined by the clock PWM CLK. For example, when the organic EL element 20 emits light at the maximum pulse width defined by 255 clocks PWM CLK, the voltage measurement pulse is generated during a 255th unit period and when the organic EL element 20 emits light at the pulse width defined by three clocks PWM CLK, the voltage measurement pulse is generated during a third unit period.

In this case, when the organic EL element 20 emits light at a very short pulse width defined by, for instance, two clocks PWM CLK, it is preferred that the anode voltage be not measured since there is a fear that the constant-current drive is not stabilized in such a case.

In this particular example, the organic EL elements 20 are driven in the constant-voltage drive for a very short time interval defined by one clock pulse during beginning of the period of emission of light and in the constant-current drive for the subsequent period of emission of light as shown at (7) and (8) in FIG. 12. In the constant-voltage drive, the organic EL elements 20 are driven at a voltage equal to the anode voltage measured in the manner described above. Accordingly, a quick rise-up inherent to the constant-voltage drive can be obtained also in this case and at the same time, since a constant current is supplied to each organic EL element 20 at this time, fluctuation in response and/or light emission of the organic EL elements 20 due to change with time of the environment of use or each organic EL element 20 can be suppressed, whereby high stability can be realized.

Further, in this particular embodiment, since the organic EL elements 20 are driven in the constant-voltage drive only for a predetermined period during the beginning of the exposure period and in the constant-current drive in the exposure period after the predetermined period, the operation of the organic EL elements 20 can be more stabilized. That is, the current-voltage characteristic of the light emitting element can be changed before completion of exposure of one image due to the self-heat generation of the element. However, by driving the organic EL elements 20 in the constant-current drive in the exposure period after the predetermined period, the light emission can be prevented from being fluctuated in the exposure period due to the error in the current by the change of the current-voltage characteristic of the organic EL elements 20.

The current-voltage characteristic of the organic EL elements 20 can be changed after the anode voltage is measured and before the image exposure is initiated. When the organic EL elements 20 are driven in the constant-voltage drive for a very short time interval defined by one clock PMW CLK from the time point at which the light emission is initiated and then in the constant-current dive as in this embodiment, the light emission can be prevented from being fluctuated in the exposure period due to the error in the current after the very short time interval, whereby adverse influence on the quality of the exposed image can be minimized.

The constant-voltage drive may be carried out for a time slightly longer than the time defined by one clock PMW CLK. For example, the constant-voltage drive may be carried out for a time defined by two clocks PMW CLK. Also in this case, an effect substantially equal to that described above can be obtained.

Though embodiments where the present invention is applied to the light emitting element array comprising a plurality of organic EL elements have been described above, the present invention can be applied to a light emitting element array comprising other light emitting elements such as LEDs or inorganic EL elements, and also in such cases, an effect substantially equal to that described above can be obtained.

Though, in the exposure systems described above, the photosensitive material is exposed to red, green and blue light, it is possible to expose the photosensitive material to other light according to its characteristics. For example, it is possible to expose the photosensitive material to cyan, magenta and yellow light. Further, the number of colors of light to which the photosensitive material is exposed need not be limited to three. For example, the number of colors of light to which the photosensitive material is exposed may be four when the photosensitive material is to be exposed to a full-color image, may be two when the photosensitive material is to be exposed to a color image which is not of a full color, and may be one when the photosensitive material is to be exposed to a monochrome image.

What is claimed is:

1. A method of driving a light emitting element array for an exposure system which is provided with a light emitting element array formed by a plurality of light emitting elements formed at the intersections of anodes and cathodes arranged in matrix so that a photosensitive material is exposed to an image formed on the light emitting element array, comprising:

driving the light emitting elements in constant-current drive before and/or during an exposure period, measuring and storing in a memory means an anode voltage of each light emitting element at that time, and driving the light emitting elements in constant-voltage drive at a voltage equal to the measured anode voltage at least during beginning of the subsequent exposure periods.

2. A method as defined in claim 1 in which the light emitting elements are driven in the constant-voltage drive at a voltage equal to the measured anode voltage for a predetermined period during the beginning of the exposure period and in the constant-current drive in the exposure period after the predetermined period.

3. A method as defined in claim 2 in which the light emitting elements are driven by a signal pulse-width-modulated according to the image data with the pulse width defined by the number of clocks and the light emitting elements are driven in the constant-voltage drive only for a time interval defined by one clock pulse from the time point at which the light emission is initiated.

4. A method as defined in claim 1, in which the light emitting elements are driven in constant-voltage drive at a voltage equal to the anode voltage when the light emitting elements are driven in constant current drive.

5. An apparatus driving a light emitting element array for an exposure system, the apparatus comprising:

a light emitting element array formed by a plurality of light emitting elements formed at the intersections of anodes and cathodes arranged in matrix; and a plurality of drive control units; each of the plurality of drive control units comprises:

a constant-current source;

a measured voltage storing circuit;

a drive voltage measuring circuit; and a constant-voltage source;

wherein each of plurality of drive control units drives the light emitting elements in constant-current drive before and/or during an exposure period, the drive voltage measuring circuit measures an anode voltage of each light emitting element during the exposure period, and stores the anode voltage in the measured voltage storing circuit; and each of the plurality of drive control units drives the light emitting elements in constant-voltage drive at a voltage equal to the stored anode voltage at least during beginning of subsequent exposure periods.

6. An apparatus as defined in claim 5 in which the plurality of light emitting elements are driven in the constant-voltage drive at a voltage equal to the measured anode voltage for a predetermined period during the beginning of the exposure period and in the constant-current drive in the exposure period after the predetermined period.

* * * * *